United States Patent [19]

Gross et al.

[11] 4,108,097

[45] Aug. 22, 1978

[54] DEVICE ON A SEWING MACHINE FOR SEVERING THREAD CHAINS

[75] Inventors: Helmut Gross, Kaiserslautern; Kurt Klundt, Hirschhorn, both of Fed. Rep. of Germany

[73] Assignee: Pfaff Industriemaschinen G.m.b.H., Fed. Rep. of Germany

[21] Appl. No.: 816,162

[22] Filed: Jul. 15, 1977

[30] Foreign Application Priority Data

Sep. 9, 1976 [DE] Fed. Rep. of Germany ..... 2640557

[51] Int. Cl.[2] ..... D05B 65/06

[52] U.S. Cl. ..... 112/287; 83/349; 83/356.3; 112/288; 112/289

[58] Field of Search ..... 112/287, 288, 289, 291, 112/293, 296; 83/349, 356.3, 542

[56] References Cited

U.S. PATENT DOCUMENTS

| | | | |
|---|---|---|---|
| 1,660,950 | 2/1928 | Zimniewicz | 83/349 X |
| 2,870,840 | 1/1959 | Kwitek | 83/349 X |
| 3,418,953 | 12/1968 | Fowler | 112/287 |
| 3,815,533 | 6/1974 | Bray | 112/287 |
| 4,038,933 | 8/1977 | Marforio | 112/288 |

*Primary Examiner*—H. Hampton Hunter
*Attorney, Agent, or Firm*—McGlew and Tuttle

[57] ABSTRACT

A device on a sewing machine for severing thread chains comprises a driven movable cutting knife which has a cutting edge disposed to move in a path in which it is spaced from a stationary counterknife. The driven knife is continuously rotated during the ordinary sewing operation, and when cutting is to be effected, the thread chain is directed so that it is moved over the counterknife to place it in a deflection position in the path of movement of the movable cutting knife and cause the movable cutting knife to move in a path in which it comes into the range of cooperative interengagement with the stationary counterknife.

8 Claims, 4 Drawing Figures

DEVICE ON A SEWING MACHINE FOR SEVERING THREAD CHAINS

FIELD AND BACKGROUND OF THE INVENTION

This invention relates in general to sewing machines and, in particular, to a new and useful device on sewing machines for severing the thread chain by means of a driven cutting knife received on a support and a stationary counterknife.

DESCRIPTION OF THE PRIOR ART

Such devices are used in the sewing industry particularly in the successive sewing of smaller workpieces in order to sever the free thread chain sections between the successive workpieces and to suck off the cut-off chain pieces through a suction pipe and into a collecting vessel. The initial thread chain is sucked off by the air current without touching the cutting knives. The thread chain is cut only when it hangs on a workpiece. The cut is made at the front edge of the workpiece by feeding the thread chain over a deflection to the cutting tools during the displacement of the workpiece. At the rear edge of the workpiece, the cut is made when the thread chain is pulled into the suction pipe by the stitch-forming tongue and fed by the workpiece over the thread chain deflection to the cutting tools (See German Patent Application No. 1,660,891 and U.S. Pat. No. 3,418,953).

In addition, a thread chain cutting device is known wherein the thread chain is chopped into small pieces to prevent clogging of the suction pipe. Due to the constant cutting, however, the knives become blunt rapidly and must be replaced relatively often or resharpened and set again, which results in a considerable loss of time (See German Patent Application No. 22 64 204).

In these known thread chain cutting devices which include a rotating or swinging cutting knife cooperating with a stationary counterknife, the cutting edges have a constant shear contact. They are therefore subject not only to considerable wear, but they are also an annoying source of noise.

SUMMARY OF THE INVENTION

The invention provides a means for increasing the service life of the cutting tools and of reducing the running noise of the cutting device. In accordance with the invention, the path of motion of the cutting edge of a cutting knife, projecting freely on its support, extends a distance from the cutting edge of the counterknife, and can be displaced by the elastic deformation caused by the thread chain bearing against the counterknife toward the range of the cutting edge of the counterknife.

Thus, the cutting edges of the cutting knife and counterknife come in shear contact during the severing cut only. As long as no cut is made during the run of the machine, the knives are contact-free. In addition to a noiseless run, this results in a considerable extension of the service life of the cutting edges and thus of the cutting tools. It is thus no longer necessary to adjust the cutting knives so often.

In order to stabilize the driven elastic cutting knife for the cutting operation and to fix the position of its cutting edge during the cutting, the extent of the displacement of the cutting knife can be limited by an abutment provided on the knife support.

In a thread chain cutting device with a cutting knife revolving in a chamber and a suction device, unwinding of the thread chain and clogging of the chamber is prevented by arranging the chamber behind the stretch-forming area laterally of the takeoff path of the thread chain, and connecting it with the suction pipe by a thread chain inlet space which comprises the range of the cutting edge of the counterknife and it is located in the takeoff direction of the chain partly under the counterknife.

The thread chain or the cutoff chain pieces need not traverse the chamber in which the cutting knife rotates. The initial free thread chain is fed into the suction pipe directly under the counterknife. It arrives on the cutting edge of the counterknife only when a new workpiece is supplied and sewn.

In order to be able to observe the interior of the chamber, it is closed with a transparent cover which is preferably provided in the initial range of the inlet space for the thread chain with a thread chain deflector.

Accordingly, it is an object of the invention to provide a device on a sewing machine for severing a thread chain which comprises a driven movable cutting knife having a cutting edge which cooperates with a stationary counterknife and which is driven to move it in a path so that it moves alongside the stationary counterknife with its cutting edge spaced slightly away therefrom and which is mounted by elastic means or includes an elastic construction such that it may be deflected by a thread chain which is positioned over the stationary cutting knife so that the outer edge of the movable cutting knife is disposed in a path of movement so that it comes into the range of cooperative cutting interengagement with the stationary counterknife.

A further object of the invention is to provide a device on a sewing machine for severing a thread chain which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
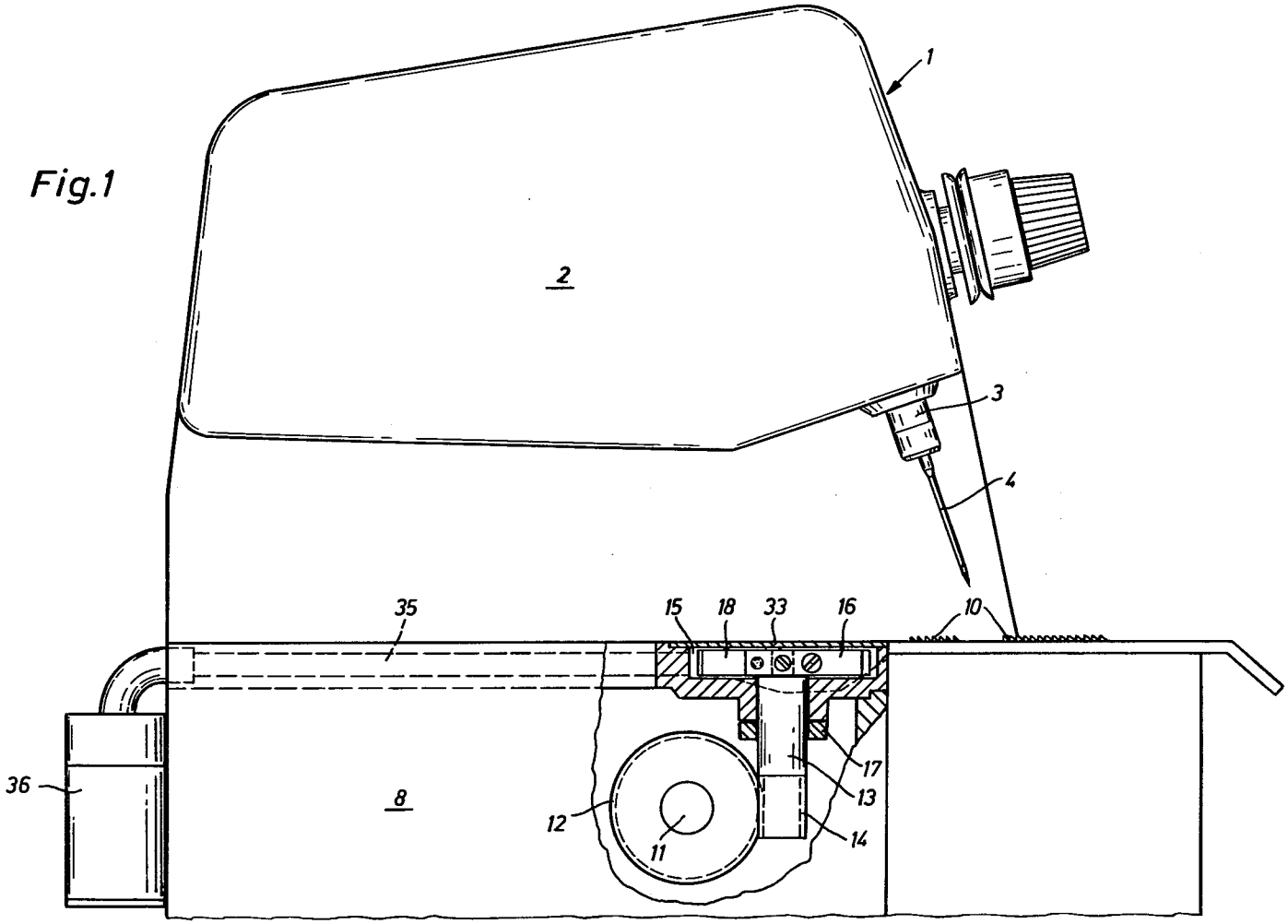
FIG. 1 is a partial side elevational and partial sectional view of a sewing machine constructed in accordance with the invention.

Referring to the drawing in particular, the embodiment selected to illustrate the invention is represented in an overcast sewing machine, generally designated 1, in the upper case 2 of which a needle bar 3 is mounted for longitudinal movement. The needle bar 3 carries a thread-carrying needle 4. Needle 4 cooperates in a known manner with loopers (not shown) to form an overcast seam (stitch type 501 or 502) which are formed around a stitch-forming tongue 5 (FIG. 2) of stitch plate 6 as an auxiliary means. Stitch plate 6 is secured with two screws 7 on the lower case 8 of sewing machine 1. It has rectangular elongated slots 9 for the passage of the toothed webs 10 and a cloth or material feeding device for effecting the transport of the sewing material with performs a rectangular movement. For the sake of clarity, the entire cloth feed mechanism and the presser of the sewing machine are not shown in the drawing.

A vertical knife shaft 13 driven by a helical gear 12 is arranged in lower case 8 of sewing machine 1 which is in engagement with a worm gear 14. A knife support 16 is secured at the upper end of the knife shaft 13 which protrudes into a chamber 15 in lower case 8 arranged behind the stitch-forming area laterally of the takeoff path of the thread chain K. The thread chain LK has its true shape only in the range of stitch-forming tongue 5, otherwise, it is represented in a simplified form. Knife shaft 13 is secured against axial displacement by a thrust ring 17. Two elastic cutting knives 18 and 19 on opposite sides of knife shaft 13 are arranged on knife support 16. One end of each of the cutting knives 18 and 19 is received in a slot 20 or 21 in knife support 16 and is secured by means of a screw 22 or 23, while the other ends are slightly bent off in a circumferential direction (Arrow D, FIG. 2), and are provided with respective cutting edges 24 and 25 and project freely. The cutting knives 18 and 19 are secured on knife support 16 so that the cutting edges 24 and 25 revolve on a circular path L indicated by a broken line in FIG. 2, which is spaced radially outwardly an amount *f*, FIG. 2, from the circular path S on which the cutting edge 26 of counterknife 27 is arranged, so that the cutting edges 24 and 25 of the cutting knives 18 and 19 have no shear contact with the cutting edge 26 of counterknife 27. Counterknife 27 is secured in a recess 28 of this lower case 8 by means of screws 29 which pass through elongated slots 30. Counterknife 27 is thus adjustable with regard to the cutting knives 18 and 19. An abutment 31 and 32, provided on knife support 16, is assigned in the range adjoining the cutting edges 24 and 25 to each respective cutting knife 18 and 19, in order to stabilize the elastic cutting knives 18 and 19 for the cutting proper and to fix their position relative to cutting edge 26 of counterknife 27.

Chamber 15, in which knife support 16 rotates with the cutting knives 18 and 19, is closed by a transparent cover 33 which is flush with the surface of lower case 8 on which the sewing material W (FIG. 3) is displaced and which also covers counterknife 27. Chamber 15 is in communication through a thread chain inlet space 34 which a suction pipe 35 which leads to a collecting vessel 36. Collecting vessel 36, which is represented in the drawing on a greatly reduced scale, includes a vacuum generator. Thread chain inlet space 34 comprises the range of cutting edge 26 of counterknife 27 and extends partly under counterknife 27 toward suction pipe 35. Cover is provided in the starting range of thread chain inlet space 34, which a deflector 37 for thread chain K extending obliquely to the take off direction of the thread chain. Thread chain K is deflected by deflector 37 in front of or to cutting edge 26 of counterknife 27 if the thread chain is connected with workpiece W and it is displaced by the cloth feed in the feeding direction of the sewing material (Arrow V, FIG. 2).

The method of operation of the new device is as follows:

Together with sewing machine 1, the vacuum generator, connected with collecting vessel 36, is also turned on. A suction air current is thus produced in the thread chain inlet space 34 which is in communication with chamber 15. The initial portion LK of the thread chain K, FIG. 2, formed around stitch-forming tongue 5 is sucked by the suction air into thread chain inlet space 34 and sucked off under counterknife 27 through suction pipe 35 to collecting vessel 36.

Chamber 15, in which knife support 16 with cutting knives 18 and 19 rotates, need not be traversed by the initial thread chain portion LK, due to its arrangement laterally of the inlet opening 34 of the take off path of the thread chain, so that coiling of the thread chain and closing of chamber 15 are avoided. While the sewing machine loops idly, that is, when there is no workpiece under the stitch-forming area, and thread chain LK is led off under counterknife 27, the cutting knives 18 and 19 assume a position in which their cutting edges 24 and 25 rotate noiselessly, free of wear, in the circular path designated L in FIG. 2, without coming into contact with the cutting edge 26 of counterknife 27.

Figure 2:
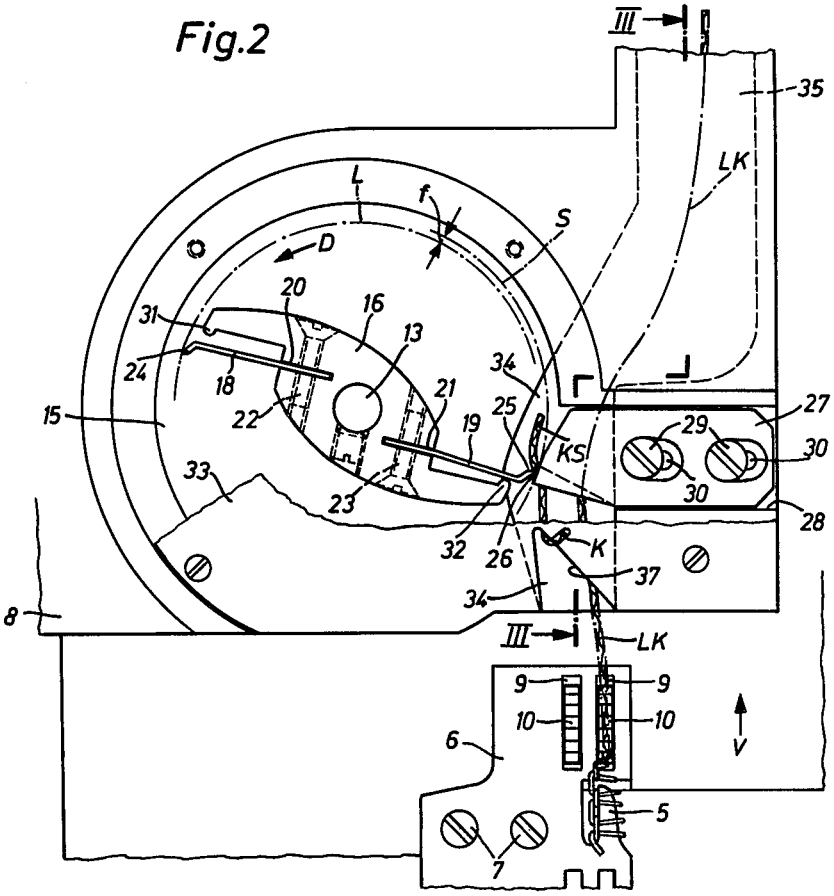
FIG. 2 is a partial top plan view showing the driven knife and the counterknife and a portion of the cloth feed mechanism of the sewing machine on an enlarged scale.
Figure 3:
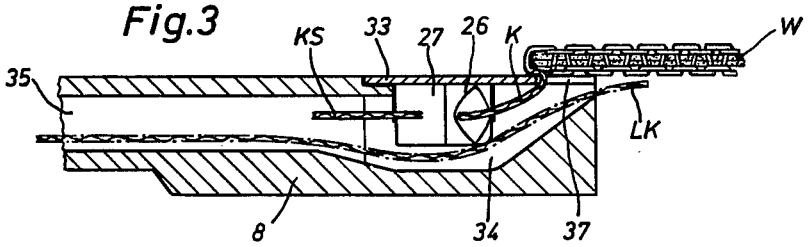
FIG. 3 is a section taken along the line III—III of FIG. 2.
Figure 4:
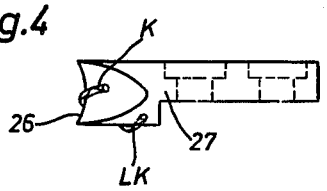
FIG. 4 is a side elevational view of the counterknife.

If a workpiece W is brought under the stitch-forming area, and thread chain LK is joined by sewing with workpiece W, the suction air current exerts a suction on the free initial thread chain K, while the end connected to the front edge of workpiece W is likewise subjected to a withdrawing force with the displacement of workpiece W in the direction of Arrow V, FIG. 2. Consequently, thread chain K is deflected sideways by deflector 37 extending obliquely to the direction of feed V and arrives on cutting edge 26 of counterknife 27. When one of the cutting edges 24 and 25 strikes on thread chain K, the respective cutting knife 18 and 19 is bent off by thread chain K bearing on counterknife 27 against the direction of rotation so far until cutting knife 18 and 19 bears on abutment 31 or 32. During this elastic deformation of cutting knife 18 or 19, its respective cutting edge 24 or 25 is displaced from the orbital plane L to the outside toward the plane designated S, on which cutting edge 26 of counterknife 27 is arranged. Thus, abutment 31 or 32 determines the cutting position of cutting knife 18 and 19.

The thread chain K hanging on workpiece W is cut through by the cooperation of cutting edge 24 or 25 with the cutting edge of counterknife 27. The cut-off thread chain piece KS is sucked through suction pipe 25 into collecting vessel 36. As soon as the cut has been performed, cutting knife 18 or 19 returns, due to its elasticity, into the starting position in which its cutting edge 24 or 25 has no shear contact with cutting edge 26 of counterknife 27.

It can be seen that the cutting edges of cutting knife 24 or 25 and counterknife 26 have shear contact for sewing the thread chain only when the thread chain is on or in front of the cutting edge of the counterknife, but they are otherwise without contact. Due to this contact-free, and therefore noiseless, run during the idle looping or sewing, the service life of the cutting edges of the cutting tools is considerably increased, and the cutting tools have a longer life expectancy.

Instead of the device represented and described as an embodiment, with cutting knives arranged on a revolving support, it is also possible to use a device where the elastic cutting knife is arranged freely projecting in a swingingly driven knife support with equally good results.

While a specific embodiment of the invention has been shown and described in detail to illustrate the application of the principles of the invention, it will be understood that the invention may be embodied otherwise without departing from such principles.

What is claimed is:

1. A device on a sewing machine for severing a thread chain, comprising a driven movable cutting knife having a cutting edge, a stationary counterknife disposed alongside said driven cutting knife, means for driving said cutting knife through a path to move it alongside said fixed counterknife with its cutting edge spaced slightly away from said fixed counterknife as it moves past said fixed counterknife, elastic means mounting said driven cutting knife for elastic deflection and displacement, means for directing a thread chain so that it is selectively moved over said counterknife to a deflection position in the path of movement of said movable cutting knife, said movable cutting knife being deflectable by said thread chain to move it to a movement path which brings it into the range of cooperative cutting interengagement with said stationary counterknife.

2. A device on a sewing machine, as claimed in claim 1, wherein said elastic means comprises a holder for said movable cutting knife with an abutment arranged in the path of deflective movement of said movable cutting knife so as to limit the amount of movement thereof during deflection.

3. A device on a sewing machine, as claimed in claim 1, including means defining a chamber in the sewing machine disposed adjacent the stitch-forming area of the sewing machine, suction means connected to said chamber for withdrawing the threads therethrough, means defining a thread chain inlet into said chamber, said chamber being of a length comparable to the length of the range of the movable cutting knife and the counterknife and which is located below said counterknife.

4. A device on a sewing machine, as claimed in claim 3, including a transparent cover closing said chamber having a thread deflector adjacent the thread inlet for deflecting the thread into the inlet space.

5. A device on a sewing machine, as claimed in claim 1, wherein said elastic means mounting said driven cutting knife comprises a cutting knife having an elastic portion and means mounting said cutting knife for movement.

6. A device on a sewing machine, as claimed in claim 5, wherein said means mounting said cutting knife for movement comprises a rotatable member, said cutting knife comprising a generally radially extending member extending outwardly from diametrically opposite sides of said member, each of said cutting knives being made of an elastic material, and abutment means on said member for limiting the movement of said elastic material upon deflection.

7. A device on a sewing machine, as claimed in claim 1, wherein said counter cutting knife comprises a knife blade, means mounting said knife blade for adjustable longitudinal movement, a rotatable member adjacent said knife blade, said movable cutting knife including first and second knife members having inner ends mounted on said movable member and outer ends extending outwardly therefrom being disposed so that their outer edge moves in an arc spaced inwardly from the cooperative cutting engagement with said counterknife, and each being of elastic material to permit deflection thereof, said counterknife having a surface over which the chain thread is movable for positioning said chain thread in the path of movement of each of said movable cutting knife members so as to deflect said members so that they rotate in a path to intercept said counterknife and cut the chain thread positioned therebetween.

8. A device on a sewing machine, as claimed in claim 7, including a deflection surface for deflecting the chain thread and a suction chamber defined in the sewing machine below said deflection member for sucking a cut thread out of the sewing machine.

* * * * *